US008446231B2

(12) United States Patent
Kawaguchi et al.

(10) Patent No.: US 8,446,231 B2
(45) Date of Patent: May 21, 2013

(54) HIGH-FREQUENCY FILTER

(75) Inventors: Tamio Kawaguchi, Kanagawa (JP); Hiroyuki Kayano, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/413,781

(22) Filed: Mar. 7, 2012

(65) Prior Publication Data

US 2012/0161907 A1 Jun. 28, 2012

Related U.S. Application Data

(63) Continuation of application No. PCT/JP2009/004718, filed on Sep. 18, 2009.

(51) Int. Cl.
*H01P 1/203* (2006.01)

(52) U.S. Cl.
USPC ..... 333/204

(58) Field of Classification Search
USPC ..... 333/204, 219
See application file for complete search history.

(56) References Cited

U.S. PATENT DOCUMENTS

| | | | | |
|---|---|---|---|---|
| 5,442,330 | A * | 8/1995 | Fuller et al. | 333/204 |
| 6,034,580 | A * | 3/2000 | Henderson et al. | 333/204 |
| 6,891,452 | B2 | 5/2005 | Mikami et al. | |
| 7,397,330 | B2 * | 7/2008 | Kayano et al. | 333/204 |
| 7,945,300 | B2 | 5/2011 | Kayano et al. | |
| 8,005,451 | B2 | 8/2011 | Kayano et al. | |
| 8,040,203 | B2 | 10/2011 | Kawaguchi et al. | |
| 2004/0041668 | A1 | 3/2004 | Mikami et al. | |
| 2008/0139142 | A1 * | 6/2008 | Kayano et al. | 455/114.3 |
| 2008/0272853 | A1 | 11/2008 | Heinze et al. | |

FOREIGN PATENT DOCUMENTS

| | | | |
|---|---|---|---|
| JP | 05-055857 | A | 3/1993 |
| JP | 10-322155 | A | 12/1998 |
| JP | 2002-290117 | A | 10/2002 |
| JP | 2003-258504 | A | 9/2003 |
| JP | 2005-033264 | A | 2/2005 |
| JP | 2008-505573 | A | 2/2008 |
| JP | 2008-289087 | A | 11/2008 |
| JP | 2009-77330 | A | 4/2009 |

OTHER PUBLICATIONS

International Search Report mailed Dec. 15, 2009, in International Application No. PCT/JP2009/004718, filed Sep. 18, 2009. (English).

* cited by examiner

*Primary Examiner* — Stephen Jones
(74) *Attorney, Agent, or Firm* — Oblon, Spivak, McClelland, Maier & Neustadt, L.L.P.

(57) ABSTRACT

One embodiment of a high-frequency filter includes a band-rejection filter including a plurality of reflection-type resonance elements and a filter circuit element provided between the reflection-type resonance elements, wherein an electrical length between the reflection-type resonance elements between which the filter circuit element is provided is an odd multiple of 90 degrees in a rejection band of the band-rejection filter.

7 Claims, 13 Drawing Sheets

HIGH-FREQUENCY FILTER

CROSS-REFERENCE TO RELATED APPLICATION

This application is continuation application based upon the International Application PCT/JP2009/004718, the International Filing Date of which is Sep. 18, 2009, the entire content of which is incorporated herein by reference.

FIELD

Embodiments described herein relate generally to a high-frequency filter

BACKGROUND

The communication device, which performs wireless or wired information communication, includes various high-frequency components such as an amplifier, a mixer, and a filter. Among them, a band-pass filter (BPF) has a function to allow only a signal in a necessary certain frequency band (desired wave) to pass. A band pass filter is formed by arranging a plurality of resonance elements. On the other hand, a band-rejection filter (BRF) has a function to attenuate a certain frequency (undesired wave) to inhibit a certain signal from passing.

In a recent wireless system in which a plurality of systems are adjacent to each other on a frequency axis and different frequencies are sometimes used in transmission and reception, the various filters are combined to limit a band and remove spurious. To meet needs for a small sized communication device, a smaller filter is desired.

JP-A 2009-77330 (KOKAI) discloses the high-frequency filter obtained by combining the band-rejection filter and the band-pass filter.

DETAILED DESCRIPTION

The high-frequency filter according to one embodiment includes a band-rejection filter including a plurality of reflection-type resonance elements and a filter circuit element provided between the reflection-type resonance elements, wherein an electrical length between the reflection-type resonance elements between which the filter circuit element is provided is an odd multiple of 90 degrees in a rejection band of the band-rejection filter.

Hereinafter, embodiments of the present invention will be described with reference to the drawings.

(First Embodiment)

A high-frequency filter of a first embodiment of the present invention includes a band-rejection filter including a plurality of reflection-type resonance elements and a filter circuit element provided between the reflection-type resonance elements, wherein an electrical length between two reflection-type resonance elements with the filter circuit element provided there is an odd multiple of 90 degrees in a rejection band of the band-rejection filter.

According to the high-frequency filter of this embodiment, it is possible to omit one transmission line of which electrical length is 90 degrees by regarding the filter circuit element as the transmission line of the band-rejection filter. Therefore, it is possible to provide a small and low-loss high-frequency filter.

Figure 1:
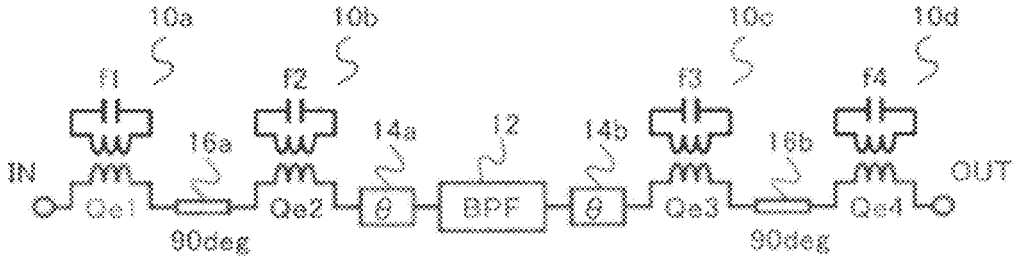
FIG. 1 is an equivalent circuit diagram of a high-frequency filter of a first embodiment.

FIG. 1 is an equivalent circuit diagram of the high-frequency filter of the first embodiment. The high-frequency filter (hereinafter, also simply referred to as a filter) includes combination of the band-rejection filter, a band-pass filter 12 which is an example of the filter circuit element, two phase adjusting elements 14*a* and 14*b* which sandwich the band-pass filter 12, and two transmission lines 16*a* and 16*b*. The filter has a structure including a pass band by the band-pass filter 12 and the rejection band by the band-rejection filter for inhibiting an undesired wave.

Herein, the band-rejection filter includes four reflection-type resonance elements 10*a*, 10*b*, 10*c*, and 10*d*. The reflection-type resonance elements 10*a* to 10*d* resonate in the rejection band of the band-rejection filter, and a structure thereof may have various shapes such as the electrical length of an odd multiple of a quarter wavelength in the rejection band, the electrical length of an integral multiple of a half wavelength, and the resonance element tap-coupled to the transmission line.

The reflection-type resonance elements 10*a* to 10*d* couple to the transmission lines with external Q Qe1 to Qe4. IL is possible to change a bandwidth of the rejection band and a rejection frequency of the band-rejection filter by changing resonance frequencies of the reflection-type resonance elements 10*a* to 10*d* and the external Q. Also, the reflection-type resonance elements 10*a* and 10*b* and the reflection-type resonance elements 10*c* and 10*d* are connected to each other by the transmission lines 16*a* and 16*b* of which electrical length is 90 degrees (quarter wavelength) in the rejection band of the band-rejection filter, respectively. Herein, the electrical length may also be an odd multiple of 90 degrees.

The band-pass filter 12 is sandwiched between the reflection-type resonance elements 10*b* and 10*c* out of the reflection-type resonance elements 10*a* to 10*d*. Herein, although the band-pass filter 12 operates as the filter in its own pass band, this may be regarded as the transmission line of a certain electrical length at each frequency in another frequency domain.

Therefore, the phase adjusting elements 14*a* and 14*b* are connected to the band-pass filter 12 to adjust a phase so as to be an odd multiple of 90 degrees in the rejection band of the band-rejection filter. That is to say, it is adjusted such that the electrical length between the reflection-type resonance elements 10*b* and 10*c* between which the band-rejection filter 12 is provided is an odd multiple of 90 degrees in the rejection band of the band-rejection filter. According to this, it is possible to allow the band-pass filter 12 and the phase adjusting elements 14*a* and 14*b* to operate as the filter in the pass band of the band-pass filter 12 and to operate as the transmission Line of 90 degrees in the rejection band of the band-rejection filter.

Therefore, the band-pass filter 12 may be regarded as the transmission line of the band-rejection filter, so that it is possible to reduce one transmission line of 90 degrees. As a result, a circuit of the high-frequency filter obtained by combining the band-rejection filter and the band-pass filter 12 may be made small.

It is most preferable that the electrical length between the reflection-type resonance elements 10*b* and 10*c* completely conform to an odd multiple of 90 degrees in the rejection band of the band-rejection filter. However, in this embodiment, "an odd multiple of 90 degrees" also includes a case in which there is an error of approximately ±30 degrees from an odd multiple of 90 degrees. This is because operation as the band-rejection filter is possible with such error even though there is deviation from ideal characteristics. It is more desirable that the error be within approximately ±5 degrees from an odd multiple of 90 degrees.

The phase adjusting elements 14*a* and 14*b* are the transmission lines for adjusting the electrical length, for example. It is also possible to provide a phase adjuster capable of adjusting the phase externally also after the filter assembly is formed as the phase adjusting elements 14*a* and 14*b*. Minute adjustment of the phase after the filter assembly is formed is possible by providing such a phase adjuster. Alternatively, also when the bandwidth of the rejection band and the rejection frequency of the band-rejection filter are changed by changing the resonance frequencies of the reflection-type resonance elements 10*a* to 10*d* and the external Q afterward, this can be coped with by adjusting the electrical length to a desired length.

The phase adjusting elements 14*a* and 14*b* are not necessarily provided on both sides of the band-pass filter 12 and it is also possible to provide the same only on one side.

Figure 2:
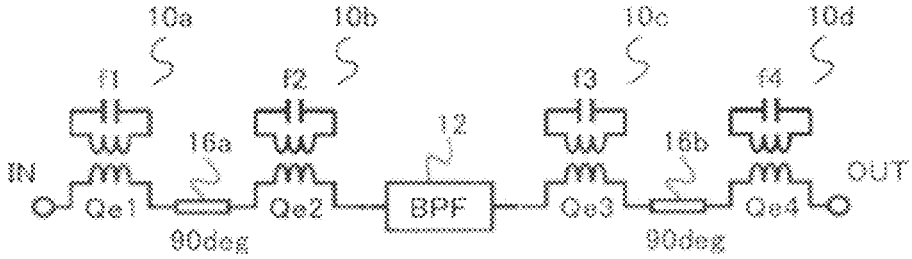
FIG. 2 is an equivalent circuit diagram of the high-frequency filter of a modified example of the first embodiment.
Figure 3:
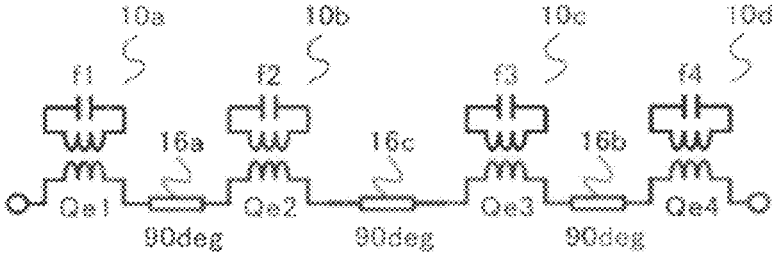
FIG. 3 is an equivalent circuit diagram of a band-rejection filter used in the first embodiment.

FIG. 2 is an equivalent circuit diagram of the high-frequency filter of a modified example of the first embodiment. In the case of the electrical length between the reflection-type resonance elements 10*b* and 10*c* is an odd multiple of 90 degrees in the rejection band of the band-rejection filter, a configuration without the phase adjusting element as in FIG. 3 is also possible.

Although the case in which the band-rejection filter includes the four reflection-type resonance elements has been described as an example in FIG. 1, the number of the reflection-type resonance elements is not limited to four and the number may be two or larger. Also, although the case in which the filter circuit element is the band-pass filter has been described as an example in FIG. 1, the filter circuit element may be a low-pass filter, or a high-pass filter, or combination thereof.

Next, a case in which the rejection band of the band-rejection filter is widened will be described. FIG. 3 is an equivalent circuit diagram of the band-rejection filter used in the first embodiment.

The band-rejection filter is configured by connecting the four reflection-type resonance elements 10*a* to 10*d* by the transmission lines 16*a*, 16*b*, and 16*c* of which electrical length is an odd multiple of 90 degrees in the rejection band of the band-rejection filter. Herein, resonance frequencies f1 to f4 of the reflection-type resonance elements 10*a* to 10*d*, respectively, are different from one another.

FIGS. 4A, 4B and 5A, 5B are explanatory diagrams of the band-rejection filter used in the first embodiment.

Figure 4A:
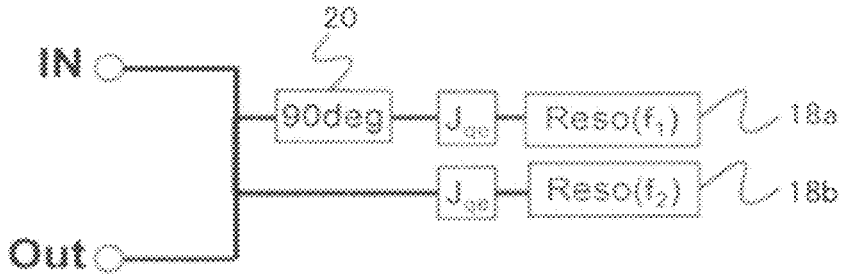
FIGS. 4A and 4B are explanatory diagrams of the band-rejection filter used in the first embodiment.
Figure 4B:
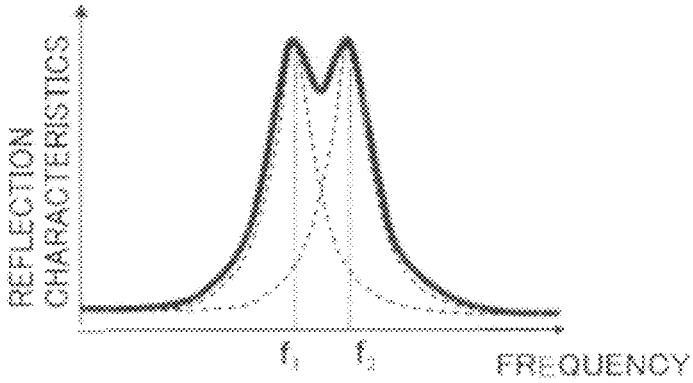
Figure 5A:
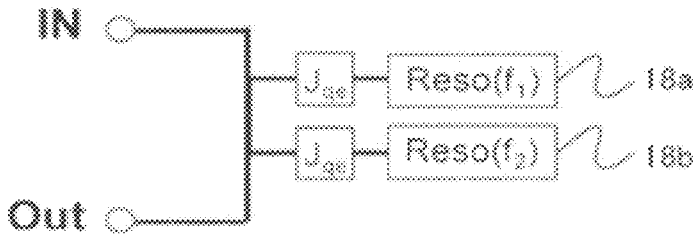
FIGS. 5A and 5B are explanatory diagrams of the band-rejection filter used in the first embodiment.
Figure 5B:
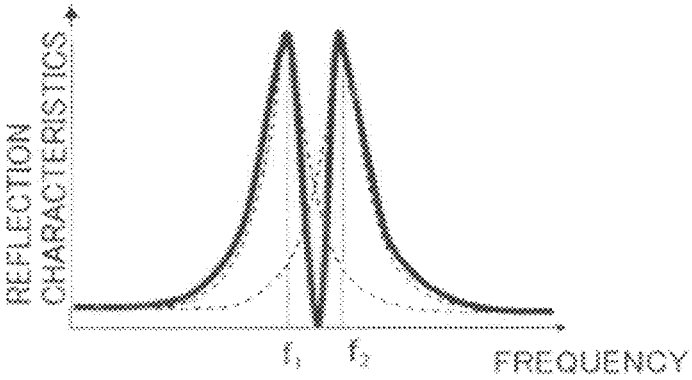
Figure 6:
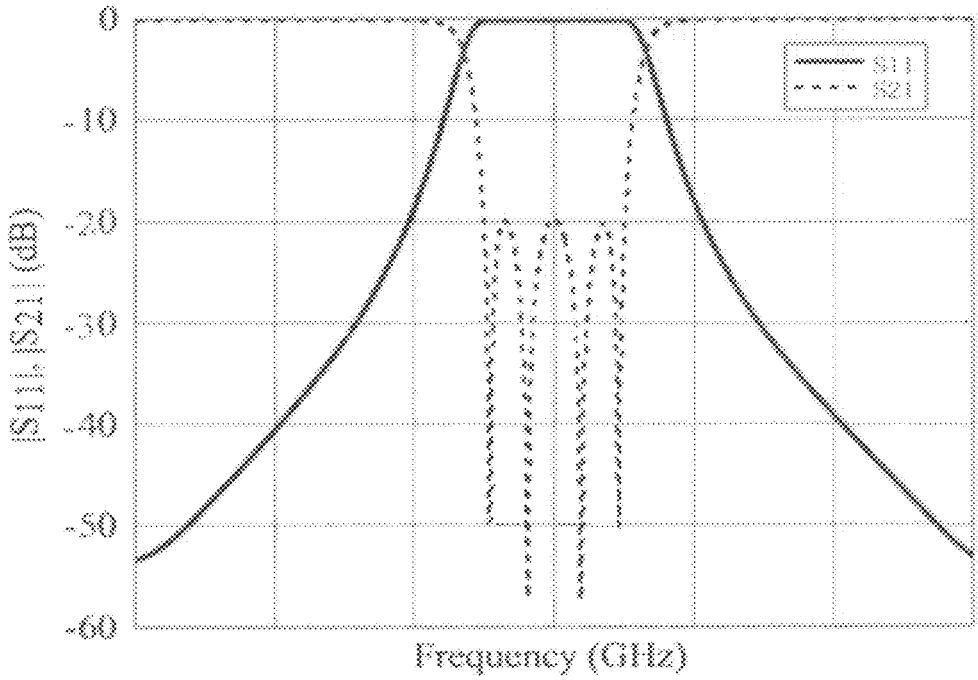
FIG. 6 is a view illustrating frequency characteristics of the high-frequency filter in FIG. 2.

FIGS. 4A and 5A are circuit diagrams in which synthesis of resonance characteristics is realized. Also, FIGS. 4B and 5B are views illustrating frequency responses of the circuits in FIGS. 4A and 5A. FIG. 6 is a view illustrating the frequency characteristics of the high-frequency filter in FIG. 3. Hereinafter, a principle of a case in which the band-rejection filter is synthesized using the reflection-type resonance elements with the different frequencies is illustrated with reference to FIGS. 4A, 4B, 5A, 5B and 6.

In FIGS. 4B and 5B, a solid line indicates the frequency characteristics of an entire circuit and a dotted line indicates reflection characteristics of each of parallelized reflection-type resonance elements. As illustrated in FIG. 4B, when two resonance waveforms are synthesized with delay difference of 180 degrees, an output is sum synthesis of the two resonance waveforms, and it is possible to configure the band-rejection filter of which rejection band is widened by adjusting coupling by an external Q value. Therefore, as illustrated in FIG. 4A, by putting a delay line 20 of an odd multiple of 90 degrees into one of the reflection-type resonance elements 18*a* and 18*b* adjacent to each other on a frequency axis, the sum synthesis becomes possible. On the other hand, when it is synthesized with the delay difference of 0 as illustrated in FIG. 5A, difference synthesis is obtained, so that the frequency characteristics are such that there is an attenuation pole on the center of the rejection band as illustrated in FIG. 5B.

Therefore, by connecting the reflection-type resonance elements 10*a* to 10*d* having the different resonance frequencies by the transmission lines (delay lines) 16*a*, 16*b*, and 16*c* of 90 degrees as illustrated in FIG. 3, it is possible to form the band-rejection filter in which the bandwidth of the rejection band is widened as illustrated in FIG. 6.

As for the band-rejection filter of which bandwidth is widened as described above also, dimension of an entire filter may be made small by replacing a 90-degree transmission line section 16*c* in FIG. 3 with the band-pass filter 12 and the phase adjusting elements 14*a* and 14*b* as illustrated in FIG. 1. Also, since the length of the transmission line section may be reduced, it is possible to reduce the transmission loss.

Figure 7:
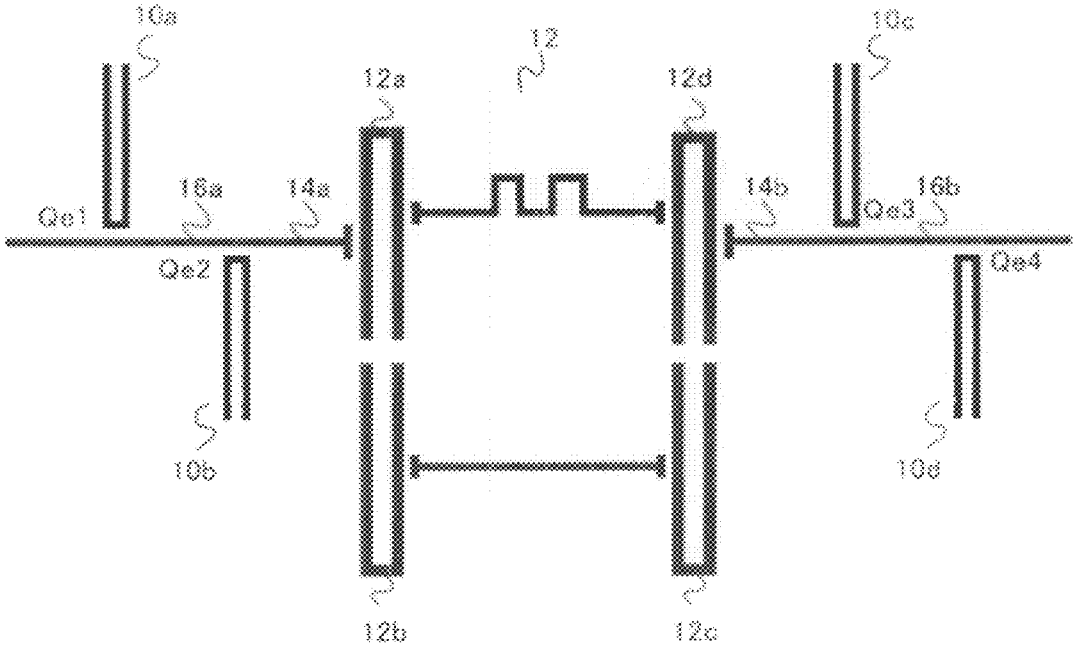
FIG. 7 is a pattern diagram of the high-frequency filter of the first embodiment.
Figure 8:
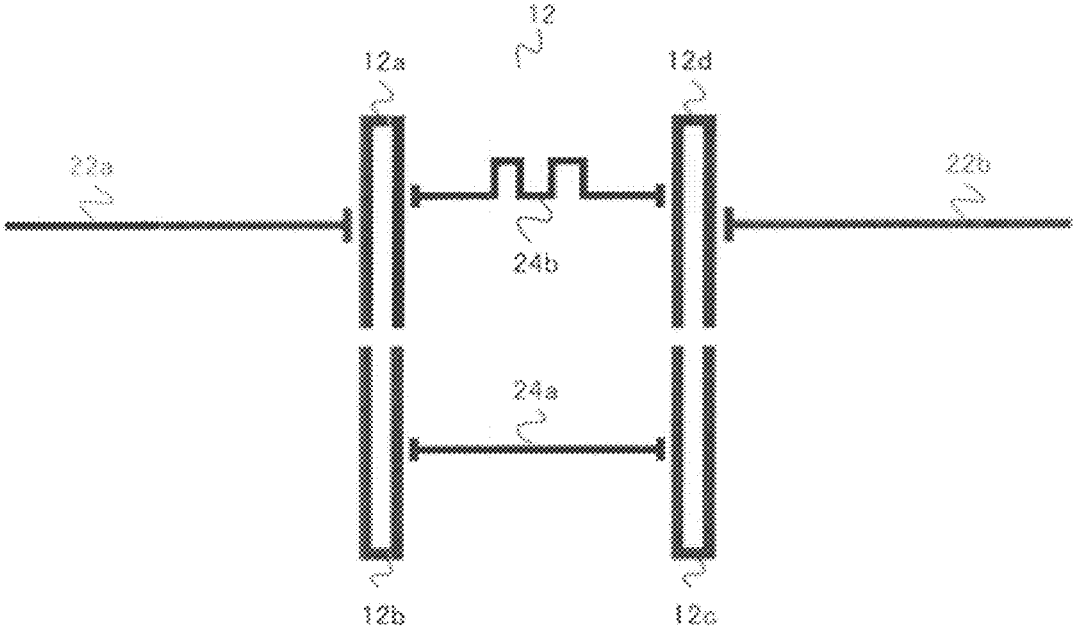
FIG. 8 is a pattern diagram of a band-pass filter of the first embodiment.
Figure 9:
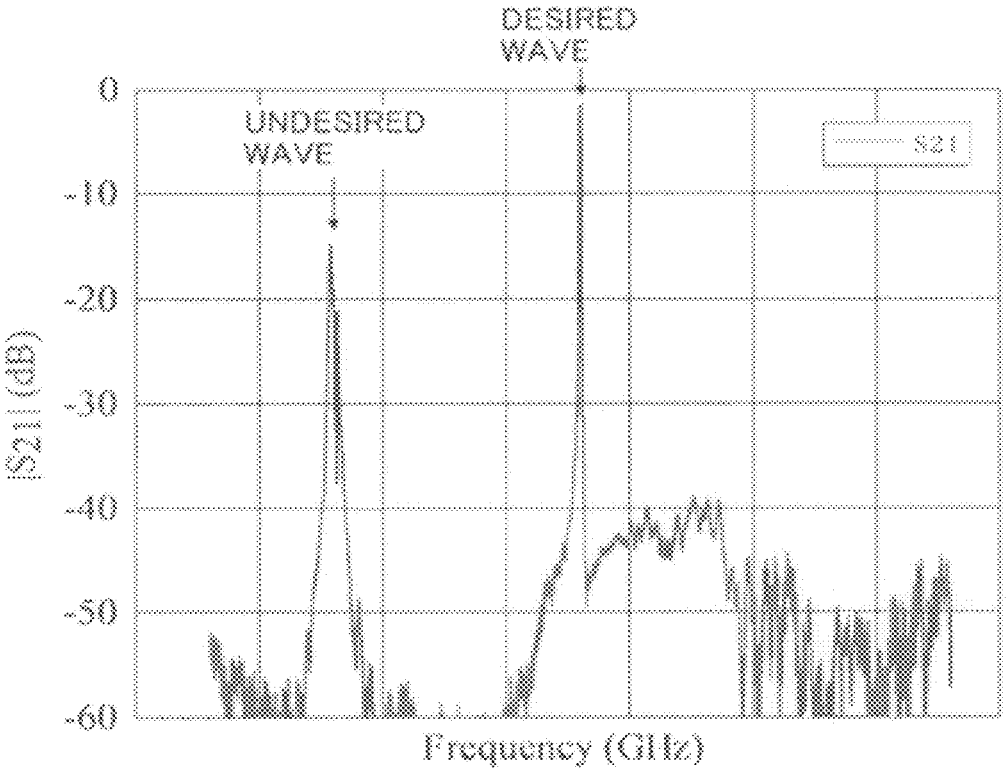
FIG. 9 is a view illustrating frequency characteristics of the band-pass filter in FIG. 8.

FIG. 7 is a pattern diagram of the high-frequency filter of the first embodiment. A filter configuration when the high-frequency filter of this embodiment illustrated in FIG. 1 is represented by a pattern of an actual microstrip line is illustrated. Also, FIG. 8 is a pattern diagram of a single piece of band-pass filter used in the first embodiment. FIG. 9 is a view illustrating the frequency characteristics of the band-pass filter in FIG. 8.

As illustrated in FIG. 8, the band-pass filter 12 is such that hairpin resonance elements 12*a*, 12*b*, 12*c*, and 12*d* of one wavelength in the pass band are connected to one another and externally connected by input/output lines 22*a* and 22*b*.

Also, coupling lines 24*a* and 24*b* are used in a part of the coupling among the resonance elements 12*a* to 12*d*. Then, it is configured such that the attenuation pole is provided outside the band by making cross coupling by the coupling line 24*b* of which electrical length is different from that of the coupling line 24*a*.

The wide band frequency characteristics of the band-pass filter are illustrated in FIG. 9. As a result, it is understood that, although a desired wave passes by the band-pass filter, the undesired wave appears on a low-band side. This is because the resonance element of the band-pass filter resonates at the half wavelength.

Then, a pattern of the filter obtained by combining the band-pass filter and the band-rejection filter for reducing only the undesired wave is illustrated in FIG. 7. Herein, hairpin resonance elements 10*a* to 10*d* of the half wavelength are used as the reflection-type resonance elements of the band-rejection filter. Also, the reflection-type resonance elements 10*a* to 10*d* have the resonance frequencies different from one another in the rejection band and are coupled to the transmission lines at the Qe1 to Qe4.

Further, the reflection-type resonance elements 10*a* and 10*b* and the reflection-type resonance elements 10*c* and 10*d* are connected to each other by the transmission lines 16*a* and 16*b* of which electrical length is 90 degrees on the center of the rejection band of the band-rejection filter, respectively. Further, the band-pass filter 12 is adjusted by the phase adjusting elements 14*a* and 14*b* such that a transmission phase is the electrical length of an odd multiple of 90 degrees on the center of the rejection band of the band-rejection filter.

Figure 10:
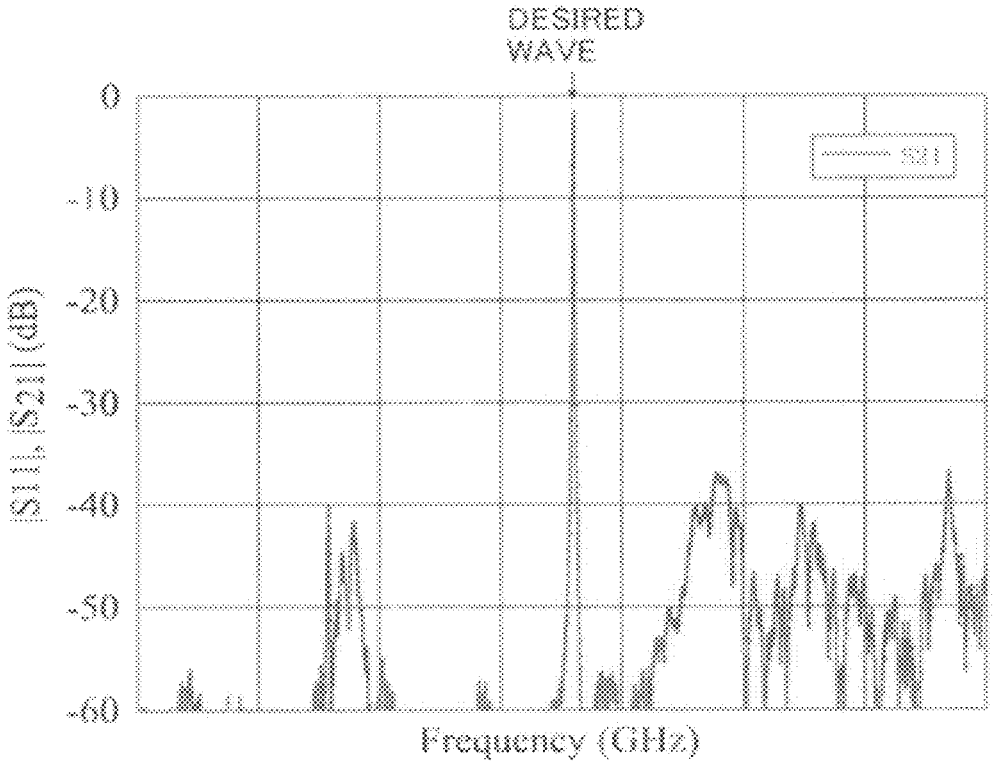
FIG. 10 is a view illustrating the frequency characteristics of the high-frequency filter in FIG. 7.

FIG. 10 is a view illustrating the frequency characteristics of the high-frequency filter in FIG. 7. It is understood that the undesired wave is reduced by the band-rejection filter and only the desired wave is taken out as compared to FIG. 9 as illustrated in FIG. 10.

The pattern in FIG. 7 is formed of a microstrip structure, for example. An insulating substrate of the microstrip structure includes a ground conductor on one surface and a line conductor on the other surface. A conducting material used as the line conductor includes metal such as copper and gold, a superconductor such as niobium and niobium tin, and a Y-based high-temperature cuprate superconductor. In this manner, it is desirable that the band-rejection filter and the filter circuit element include the superconductor for realizing low-loss and high-efficiency filter.

The insulating substrate is a material such as magnesium oxide, sapphire, and lanthanum aluminate, for example. For example, a superconducting microstrip line is formed on a magnesium oxide substrate of which thickness is approximately 0.43 mm and relative permittivity is approximately 10.

Herein, a Y-based high-temperature cuprate superconducting thin film of which thickness is approximately 500 nm is used, for example, as the superconductor of the microstrip line and a line width of the strip conductor is approximately 0.4 mm, for example. It is also possible to provide a buffer layer between the insulating substrate and the superconducting film in order to obtain an excellent Y-based cuprate superconducting film. Examples of the buffer layer include $CeO_2$ and YSZ.

The superconducting thin film may be formed by a laser evaporation method, sputtering, a co-evaporation method, a MOD method and the like. Also, as a filter structure, there are various structures such as a strip line, a coplanar line, a waveguide, a coaxial line in addition to the microstrip line. Further, in addition to the above-described structures, various resonators such as a dielectric resonator and cavity resonator may be used.

As described above, according to the high-frequency filter of this embodiment, it is possible to omit one transmission line of which electrical length is 90 degrees by regarding the filter circuit element as the transmission line of the band-rejection filter. Therefore, it is possible to provide the small and low-loss high-frequency filter.

(Second Embodiment)

The high-frequency filter of this embodiment is similar to that of the first embodiment except that a coupled resonator having two pass bands including the two resonance elements in place of the hairpin resonance element is used as the band-pass filter of the high-frequency filter of the first embodiment. Therefore, the contents overlapping with those of the first embodiment will not be repeated.

Figure 11:
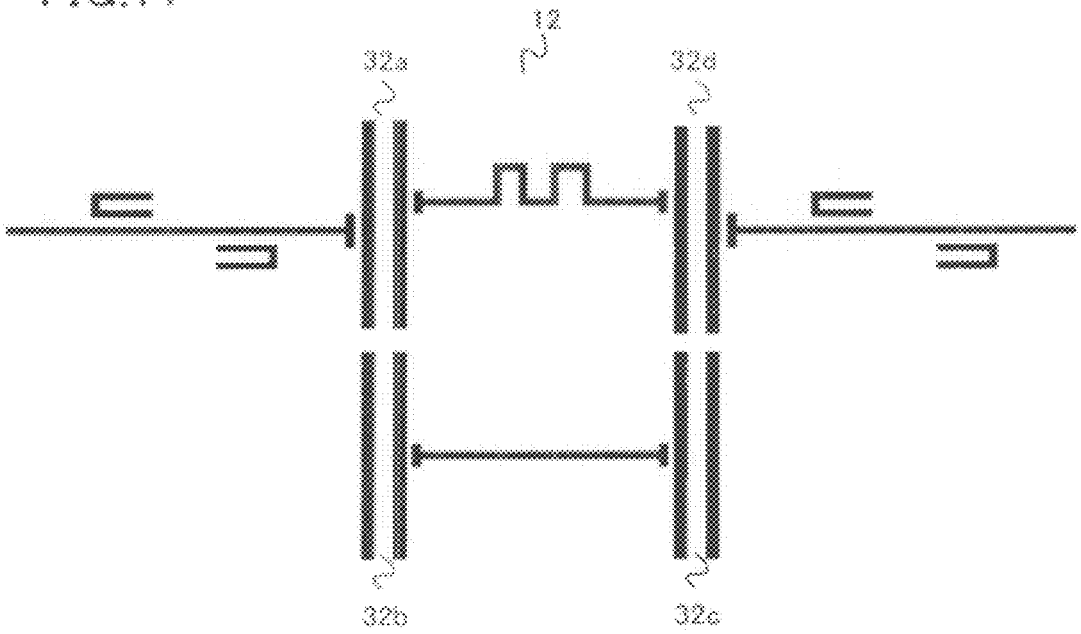
FIG. 11 is a pattern diagram of the high-frequency filter of a second embodiment.
Figure 12:
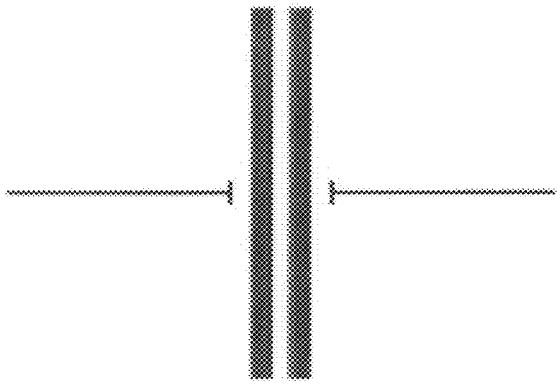
FIG. 12 is a pattern diagram of a coupled resonator used in the second embodiment.
Figure 13:
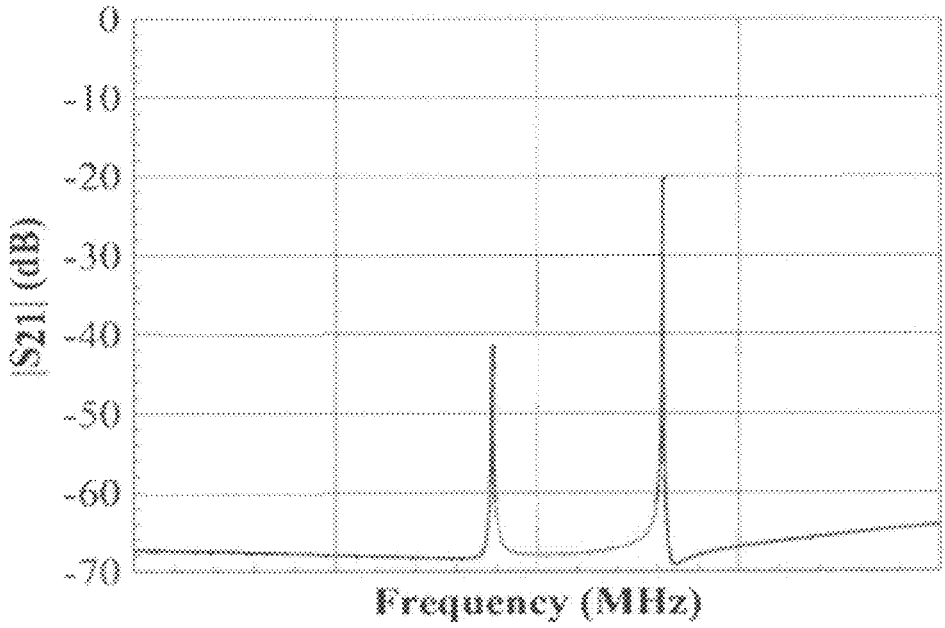
FIG. 13 is a view illustrating the frequency characteristics of the coupled resonator in FIG. 12.

FIG. 11 is a pattern diagram of the high-frequency filter of a second embodiment. FIG. 12 is a pattern diagram of the coupled resonator used in the high-frequency filter in FIG. 11. Also, FIG. 13 is a view illustrating the frequency characteristics of the coupled resonator in FIG. 12.

As illustrated in FIG. 11, the band-pass filter 12 of the high-frequency filter of this embodiment includes coupled resonators 32*a*, 32*b*, 32*c*, and 32*d* each obtained by coupling the two resonance elements. With the coupled resonator obtained by coupling the two resonance elements as illustrated in FIG. 12, two split resonance peaks appear as illustrated in FIG. 13. That is to say, this has two pass bands. Then, in the filter using the coupled resonator, one of the peaks is used in the band-pass filter as the desired wave.

The band-pass filter using the coupled resonator can control an interval between the split peaks by changing the degree of coupling of the two resonance elements, which configure the resonator, so that this is suitable to make a small pattern. However, the other of the split resonance peaks naturally becomes the undesired wave as described above.

In this embodiment, by combining the band-pass filter using the coupled resonator and the band-rejection filter, it is possible to attenuate the above-described undesired wave inevitably generated in the band-pass filter. Therefore, it is possible to realize the small and low-loss high-frequency filter.

(Third Embodiment)

The high-frequency filter of this embodiment is similar to that of the first embodiment except that the low-pass filter is newly combined as the filter circuit element and that the number of the reflection-type resonance elements is changed from four to three. Therefore, the contents overlapping with those of the first embodiment will not be repeated.

Figure 14:
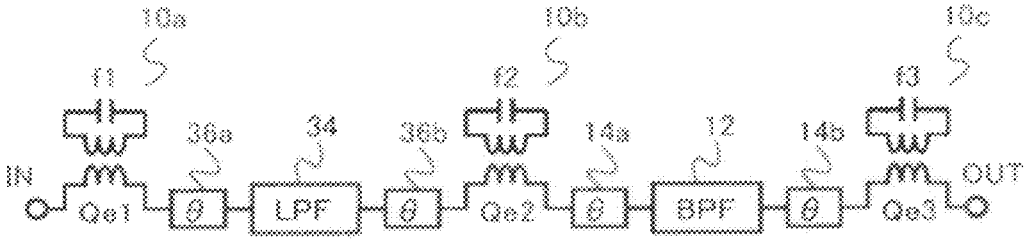
FIG. 14 is an equivalent circuit diagram of the high-frequency filter of a third embodiment.

FIG. 14 is an equivalent circuit diagram of the high-frequency filter of a third embodiment. The filter has a configuration in which a low-pass filter 34 for removing a harmonic and spurious, the band-pass filter 12, and the band-rejection filter are combined. The structure is such that the low-pass filter 34 and the band-pass filter 12 are combined between each of the reflection-type resonance elements 10*a* to 10*c*, which configure the band-rejection filter.

An operating principle of the band-pass filter 12 is as described in the first embodiment. In this embodiment, phase adjusting elements 36*a* and 36*b* are further connected to the low-pass filter 34 to adjust the phase so as to be an odd multiple of 90 degrees in the rejection band of the band-rejection filter. According to this, the low-pass filter 34 and the phase adjusting elements 36*a* and 36*b* may be allowed to operate as the transmission line of which electrical length is 90 degrees in the rejection band of the band-rejection filter.

Therefore, since the low-pass filter 34 may also be regarded as the transmission line as the band-pass filter 12, it is possible to reduce two transmission lines of 90 degrees. Therefore, the circuit of the high-frequency filter obtained by combining the band-rejection filter, the band-pass filter, and the low-pass filter may be made small.

Figure 15:
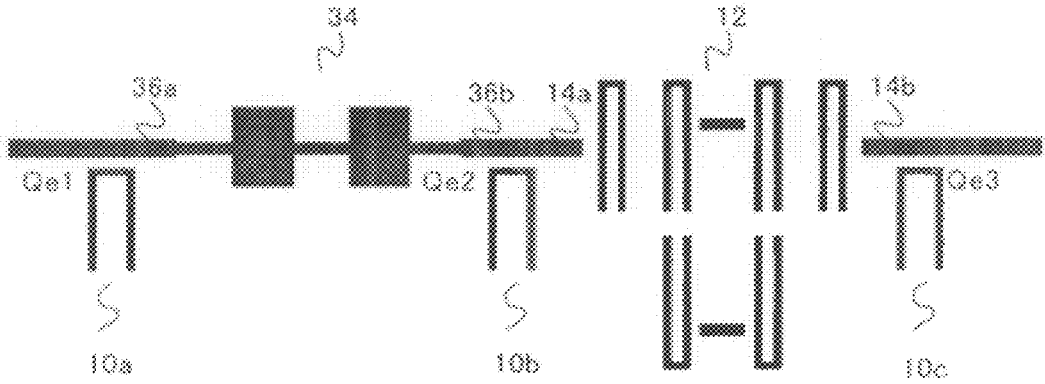
FIG. 15 is a pattern diagram of the high-frequency filter of the third embodiment.

FIG. 15 is a pattern diagram of the high-frequency filter in FIG. 14. A pattern in which the filter in FIG. 14 is represented by the microstrip line is illustrated. Herein, the low-pass filter 34 has a five-stage configuration in which lines with different characteristic impedances are connected. The phase is adjusted by the phase adjusting elements 36*a* and 36*b*.

Figure 16:
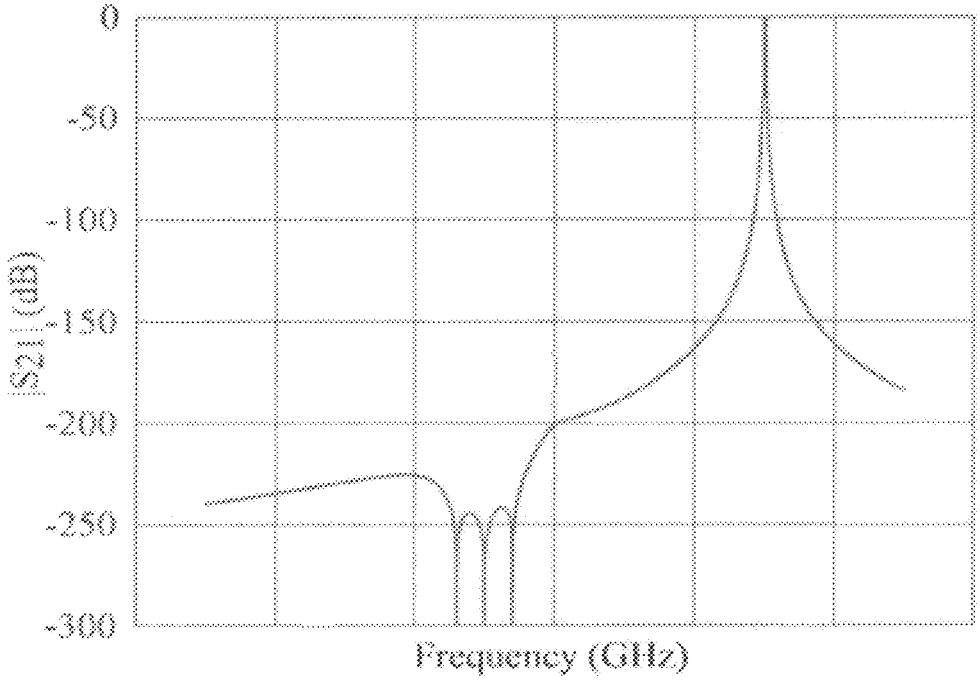
FIG. 16 is a view illustrating the frequency characteristics of the high-frequency filter in FIG. 15.

Also, the band-pass filter has a six-stage configuration and the band-rejection filter includes three-stage reflection-type resonance elements 10*a* to 10*c*. FIG. 16 is a view illustrating the frequency characteristics of the high-frequency filter in FIG. 15. From FIG. 16, it is understood that attenuation partially becomes larger on the low-band side by the band-rejection filter.

(Fourth Embodiment)

The high-frequency filter of this embodiment is similar to that of the third embodiment except that the low-pass filter is changed to the high-pass filter. Therefore, the contents overlapping with those of the third embodiment will not be repeated.

Figure 17:
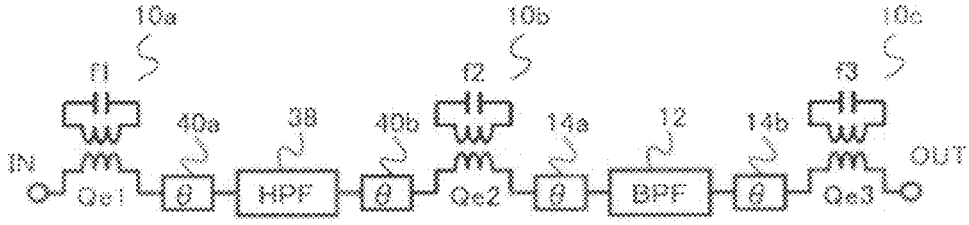
FIG. 17 is an equivalent circuit diagram of the high-frequency filter of a fourth embodiment.

FIG. 17 is an equivalent circuit diagram of the high-frequency filter of a fourth embodiment. The filter has a configuration in which a high-pass filter 38 for removing the harmonic and the spurious, the band-pass filter 12, and the band-rejection filter are combined. The structure is such that the high-pass filter 38 and the band-pass filter 12 are combined between each of the reflection-type resonance elements 10*a* to 10*c*, which configure the band-rejection filter.

The operating principle of the band-pass filter 12 is as described in the first embodiment. In this embodiment, phase adjusting elements 40*a* and 40*b* are further connected to the high-pass filter 38 to adjust the phase so as to be an odd multiple of 90 degrees in the rejection band of the band-rejection filter. According to this, operation as the transmission line of which electrical length is 90 degrees in the rejection band of the band-rejection filter becomes possible.

Figure 18:
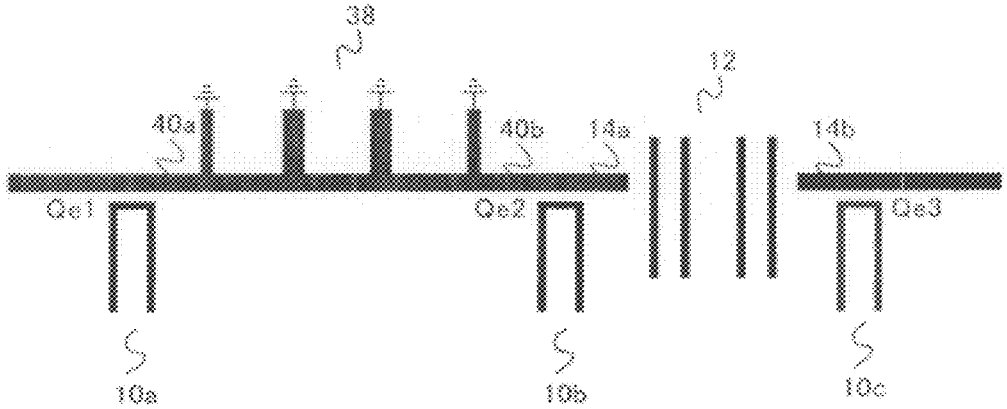
FIG. 18 is a pattern diagram of the high-frequency filter of the fourth embodiment.

FIG. 18 is a pattern diagram of the high-frequency filter in FIG. 17. The filter in FIG. 17 is represented by the microstrip line. Herein, the high-pass filter 38 has a four-stage configuration in which short-ended quarter wavelength resonators are connected by a quarter wavelength line. Further, the phase is adjusted by the phase adjusting elements 40*a* and 40*b*. Also, the band-pass filter 12 has a four-stage configuration and the band-rejection filter includes the three-stage reflection-type resonance elements 10*a* to 10*c*.

According to this embodiment, the circuit of the high-frequency filter obtained by combining the band-rejection filter, the band-pass filter, and the high-pass filter may be made small.

(Fifth Embodiment)

The high-frequency filter of this embodiment is similar to that of the fourth embodiment except that the band-pass filter is changed to the low-pass filter. Therefore, the contents overlapping with those of the fourth embodiment will not be repeated.

Figure 19:
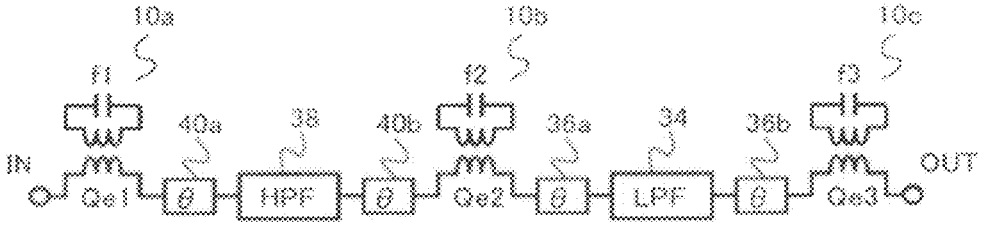
FIG. 19 is an equivalent circuit diagram of the high-frequency filter of a fifth embodiment.

FIG. 19 is an equivalent circuit diagram of the high-frequency filter of a fifth embodiment. The filter has a configuration in which the high-pass filter 38 for removing the harmonic and the spurious, the low-pass filter 34, and the band-rejection filter are combined. The structure is such that the high-pass filter 38 and the low-pass filter 34 are combined between each of the reflection-type resonance elements 10*a* to 10*c*, which configure the band-rejection filter.

In this embodiment, phase adjusting elements 40*a* and 40*b* are further connected to the high-pass filter 38 to adjust the phase so as to be an odd multiple of 90 degrees in the rejection band of the band-rejection filter. According to this, the high-pass filter 38 and the phase adjusting elements 40*a* and 40*b* may be allowed to operate as the transmission line of which electrical length is 90 degrees in the rejection band of the band-rejection filter.

Also, the phase adjusting elements 36*a* and 36*b* are connected to the low-pass filter 34 to adjust the phase so as to be an odd multiple of 90 degrees in the rejection band of the band-rejection filter. According to this, the low-pass filter 34 and the phase adjusting elements 36*a* and 36*b* may be allowed to operate as the transmission line of which electrical length is 90 degrees in the rejection band of the band-rejection filter.

Figure 20:
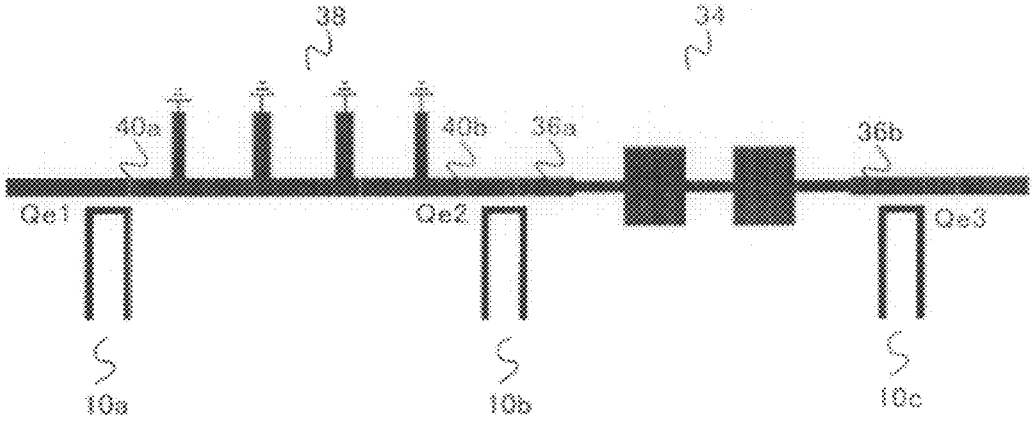
FIG. 20 is a pattern diagram of the high-frequency filter of the fifth embodiment.

FIG. 20 is a pattern diagram of the high-frequency filter in FIG. 19. The filter in FIG. 19 is represented by the microstrip line. The pattern of the high-pass filter 38 is similar to that of the fourth embodiment. Also, the pattern of the low-pass filter 34 is similar to that of the third embodiment.

According to this embodiment, the circuit of the high-frequency filter obtained by combining the band-rejection filter, the high-pass filter, and the low-pass filter may be made small.

(Sixth Embodiment)

The high-frequency filter of this embodiment is similar to that of the third embodiment except that the configuration of the reflection-type resonance element of the band-pass filter is changed. Therefore, the contents overlapping with those of the third embodiment will not be repeated.

Figure 21:
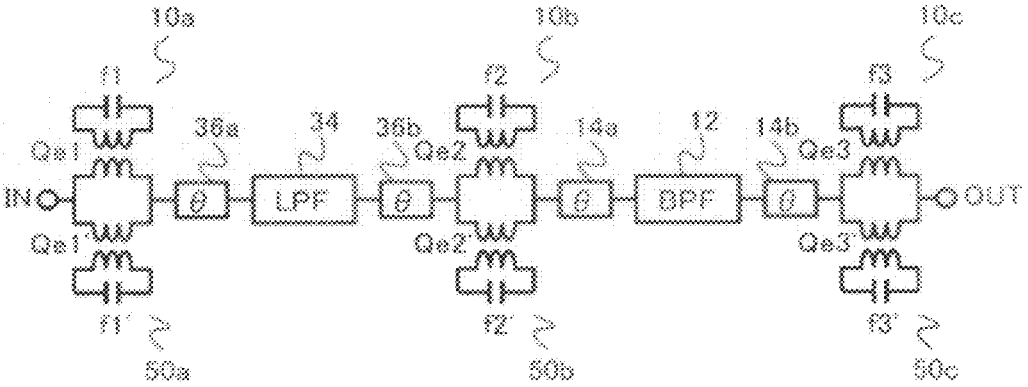
FIG. 21 is an equivalent circuit diagram of the high-frequency filter of a sixth embodiment.

FIG. 21 is an equivalent circuit diagram of the high-frequency filter of a sixth embodiment. In this filter, the band-rejection filter has two different rejection bands. For this purpose, reflection-type resonance elements 10*a* and 50*a*, 10*b* and 50*b*, and 10*c* and 50*c* having the different resonance frequencies are connected in parallel and coupled to the line with the external Q Qe1 and Qe1', Qe2 and Qe2', and Qe3 and Qe3', respectively, thereby configuring the band-rejection filter.

The structure is such that the low-pass filter 34 and the band-pass filter 12 are combined between each of the reflection-type resonance elements 10*a* to 10*c* and 50*a* to 50*c*, which configure the band-rejection filter.

Figure 22:
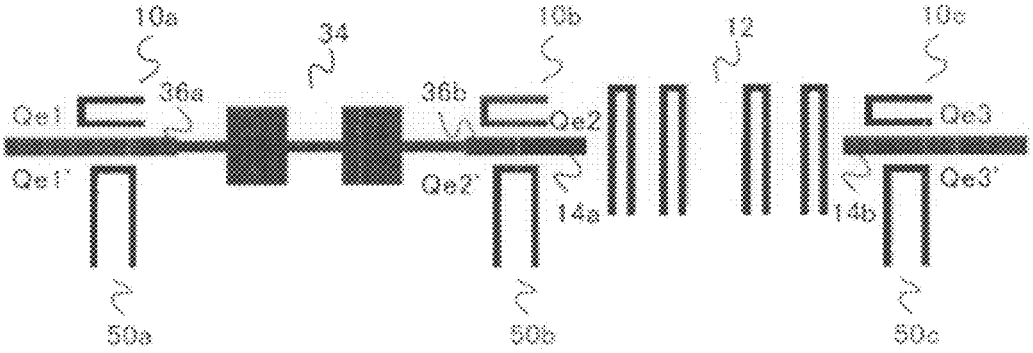
FIG. 22 is a pattern diagram of the high-frequency filter of the sixth embodiment.

FIG. 22 is a pattern diagram of the high-frequency filter of this embodiment. The filter in FIG. 21 is represented by the microstrip line.

According to this embodiment, the circuit of the high-frequency filter obtained by combining the band-rejection filter having the two different rejection bands, the band-pass filter, and the low-pass filter may be made small.

(Seventh Embodiment)

The high-frequency filter of this embodiment is similar to that of the third embodiment except that the configuration of the low-pass filter and the band-pass filter section is changed. Therefore, the contents overlapping with those of the third embodiment will not be repeated.

Figure 23:
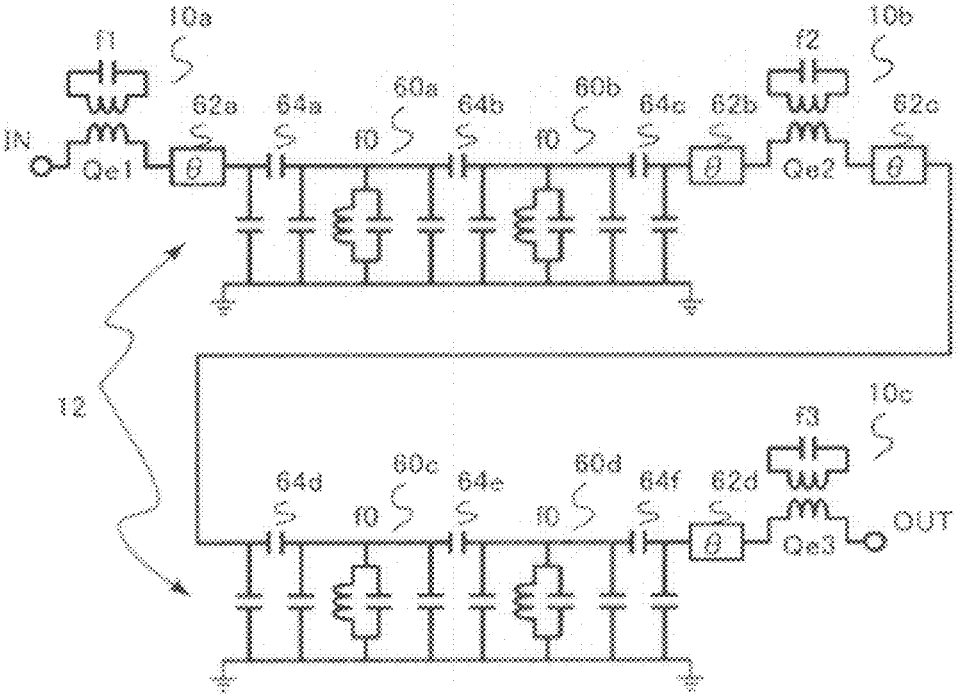
FIG. 23 is an equivalent circuit diagram of the high-frequency filter of a seventh embodiment.
Figure 24:
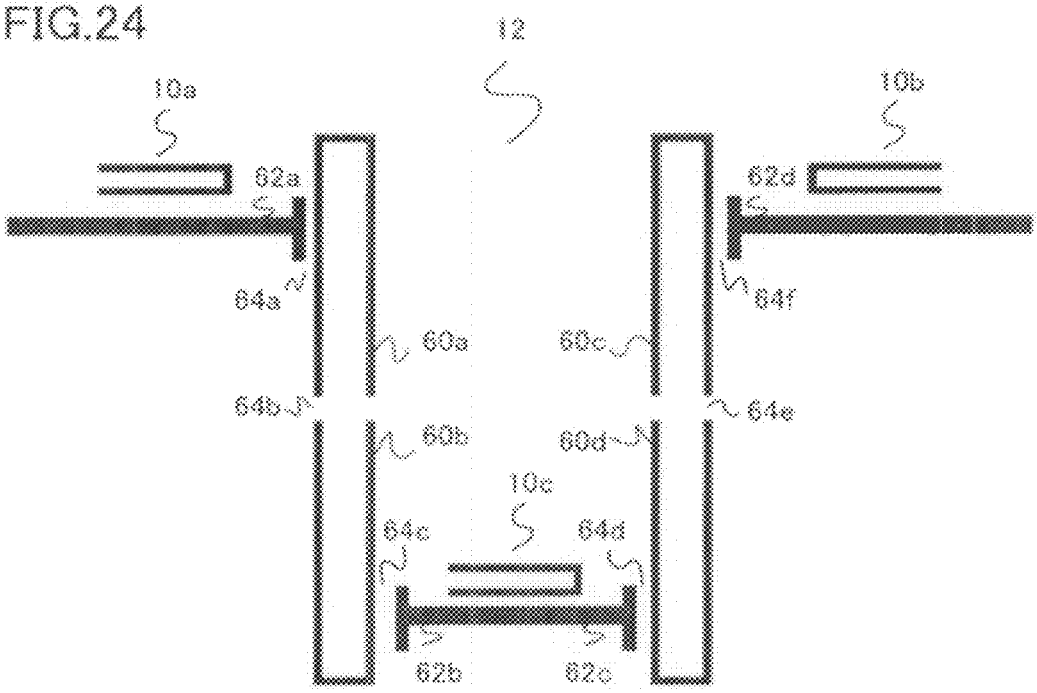
FIG. 24 is a pattern diagram of the high-frequency filter of The seventh embodiment.

FIG. 23 is an equivalent circuit diagram of the high-frequency filter of a seventh embodiment. In this filter, the band-rejection filter includes a plurality of reflection-type resonance elements 10*a* to 10*c*. Then, the band-pass filter 12 includes a resonance element group including a plurality of resonance elements 60*a* to 60*d* having a resonance frequency of f0. The structure is such that the resonance element group is divided in half and put between each of the reflection-type resonance elements, which configure the band-rejection filter. In other words, the structure is such that, the reflection-type resonance element is provided between the resonance elements, which configure the band-pass filter 12.

The resonance element group divided in half is connected to the reflection-type resonance elements 10*a* to 10*c* using phase adjusting elements 62*a* to 62*d*. Also, in the band-pass filter 12, a plurality of resonance elements 60*a* to 60*d* are coupled to one another to form the band, so that this has coupling sections 64*a* to 64*f*.

Herein, the band-pass filter 12 may be the circuit in which the resonators are parallel to each other. In this case, the resonance frequencies of the resonance elements are different from each other and synthesized using the delay line and the like in consideration of a phase relationship.

FIG. 21 is a pattern diagram of the high-frequency filter of this embodiment. The filter in FIG. 23 is represented by the microstrip line.

As described above, by a configuration in which components of the band-pass filter are divided and each divided portion is regarded as a 90-degree line, the dimension of the entire filter may be made small. According to this embodiment, the circuit of the high-frequency filter obtained by combining the band-rejection filter and the band-pass filter may be made small.

While certain embodiments have been described, these embodiments have been presented by way of example only, and are not intended to limit the scope of the inventions. Indeed, high-frequency filters described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

What is claimed is:

1. A high-frequency filter, comprising:

a band-rejection filter including a plurality of reflection-type resonance elements; and a filter circuit element provided between two directly adjacent reflection-type resonance elements selected from the reflection-type resonance elements, wherein an entire electrical length between the two directly adjacent reflection-type resonance elements is an odd multiple of 90 degrees in a rejection band of the band-rejection filter.

2. The filter according to claim 1, wherein the filter circuit element is any one of a band-pass filter, a low-pass filter, and a high-pass filter or combination thereof.

3. The filter according to claim 1, wherein a phase adjusting element is provided between the two directly adjacent reflection-type resonance elements.

4. The filter according to claim 1, wherein the filter circuit element is a coupled resonator having two pass bands including two resonance elements and one of the pass bands is overlapped with the rejection band of the band-rejection filter.

5. The filter according to claim 1, wherein the band-rejection filter includes three or more reflection-type resonance elements, the filter circuit element includes a plurality of resonance elements, and the reflection-type resonance elements are provided between the resonance elements.

6. The filter according to claim 1, wherein the plurality of reflection-type resonance elements include two reflection-type resonance elements having different rejection bands connected in parallel.

7. The filter according to claim 1, wherein the band-rejection filter and the filter circuit element include an superconductor.

* * * * *